US005179749A

United States Patent [19]

Magee

[11] Patent Number: 5,179,749

[45] Date of Patent: Jan. 19, 1993

[54] SEAMLESS MODULAR TILE

[75] Inventor: Ronald Magee, LaGrange, Ga.

[73] Assignee: Milliken Research Corporation, Spartanburg, S.C.

[21] Appl. No.: 695,966

[22] Filed: May 6, 1991

[51] Int. Cl.[5] ..... D06B 1/02

[52] U.S. Cl. ..... 8/150; 364/470

[58] Field of Search ..... 8/150, 151, 149; 68/205 R; 428/62, 92, 96; D5/39, 58; 118/323

[56] References Cited

U.S. PATENT DOCUMENTS

| | | | |
|---|---|---|---|
| D. 91,243 | 12/1933 | McCabe . | |
| D. 154,151 | 6/1949 | Ryan . | |
| D. 154,156 | 6/1949 | Ryan . | |
| D. 154,160 | 6/1949 | Ryan . | |
| D. 154,168 | 6/1949 | Ryan . | |
| D. 154,179 | 6/1949 | Ryan . | |
| 1,783,454 | 12/1930 | Schmieder . | |
| 2,510,563 | 6/1950 | Dow . | |
| 2,524,456 | 10/1950 | Masland, II | 428/62 |
| 3,862,874 | 1/1975 | Hopper et al. | 428/62 X |
| 4,347,273 | 8/1982 | Dale . | |
| 4,369,640 | 1/1983 | Fox | 68/205 R |
| 4,371,371 | 2/1983 | Smrekar | 68/205 R X |
| 4,546,025 | 10/1985 | Vaisman . | |
| 4,803,746 | 2/1989 | Bryant | 68/205 R X |
| 4,902,540 | 2/1990 | Martino | 428/62 X |
| 4,919,743 | 4/1990 | Jonnston et al. | 428/62 X |
| 4,979,380 | 12/1990 | Robbins et al. | 68/205 R |
| 4,984,169 | 1/1991 | Jonnson, Jr. | 68/205 R |

FOREIGN PATENT DOCUMENTS

| | | | |
|---|---|---|---|
| 2597892 | 10/1987 | France | 428/62 |

*Primary Examiner*—Frankie L. Stinson

*Attorney, Agent, or Firm*—Earle R. Marden; H. William Petry

[57] ABSTRACT

Method to jet dry carpet tiles by controlling the solenoid valve to the dye jet to provide a subliminal design over which a darker geometric design is imposed with the darker geometric design crossing the seam line so that the seam line between abutting carpet tiles is very indistinct to the human eye.

8 Claims, 4 Drawing Sheets

SEAMLESS MODULAR TILE

This invention relates to a method to dye carpet tiles so that when the carpet tiles are laid side by side that the tendency of the seam line where the tiles abut to be visible, is substantially reduced.

Many techniques are known for the application of dyestuffs to textile substrates, and particularly the application of dyestuffs to such substrates in a pattern configuration. Among such techniques, it has been found advantageous to apply dye in the form of discrete streams of dye, formed and directed by a plurality of dye-emitting orifices. Ideally, each individual stream may be intermittently interrupted or diverted in accordance with pattern information. Dyeing systems of this latter type are generally described in greater detail in, for example, U.S. Pat. Nos. 3,894,413, 3,942,343, 4,033,154, 4,034,584, 4,116,626, 4,309,881, 4,434,632, and 4,584,854.

These systems are commonly configured in the form of a conveyor which transports the substrate to be dyed under a plurality of such continuously flowing discrete dye streams. In a preferred embodiment, a plurality of dye orifices, each directed at the substrate, are arranged in several individual linear arrays positioned generally above and across the substrate path in spaced, parallel alignment, with each array being associated with a separate source (e.g., a different color) of liquid dye. Generally, each of the arrays is positioned in close proximity to the substrate to be dyed, with typical clearance between the array and the substrate surface being substantially less than one inch. The individual continuously flowing dye streams in a given array are normally directed onto the substrate surface. However, by means of a transverse intersecting stream of diverting air which is aligned with each dye stream and which is actuated or interrupted in response to externally supplied pattern information, the continuously flowing stream may be directed into a collection chamber or catch basin so as to prevent any dye from contacting the substrate.

To accurately control the amount of dye applied to a given location on the material during the dyeing operation, and to insure that the dye strikes the material in a very small, precise spot, the lower portion of the collection chamber contains a collector plate supportably positioned in spaced relation above the lower wall of the collection chamber. This collector plate is adjustably attached to the lower wall of the collection chamber by way of an elongate collector plate support member which forms an extension of the lower wall of the collection chamber. By means of careful adjustment of the position of the collector plate relative to the collector plate support member, the leading edge of the collector plate can be accurately positioned relative to the dye discharge axes of the array to insure prompt and precise interception of the streams when deflected. Details of such a dyeing apparatus and collection chamber construction are described and claimed in commonly assigned U.S. Pat. No. 3,942,343, referenced above. As described therein, each dye stream, when deflected, passes across the edge of the collector plate and into the collection chamber. Upon removal of the deflecting air stream, the stream moves back across the plate edge and resumes its normal path of travel toward the material to be dyed.

In recent years the industry has been using carpet tiles (i.e., 18" square) laid side by side to cover the desired area. These tiles are generally cut from a wide width of carpet and then dyed in the aforementioned manner. It has been found in tiles that have a design thereon that it is very difficult to lay the tiles without the abutting joint of adjacent tiles being seen to the naked eye by a casual observer.

Therefore, it is an object of the invention to provide a method of dyeing carpet tiles to alleviate the rowing or zipper effect observed after the tiles have been installed.

Other objects and advantages of the invention will become readily apparent as the specification proceeds to describe the invention with reference to the accompanying drawings, in which.

Figure 4:
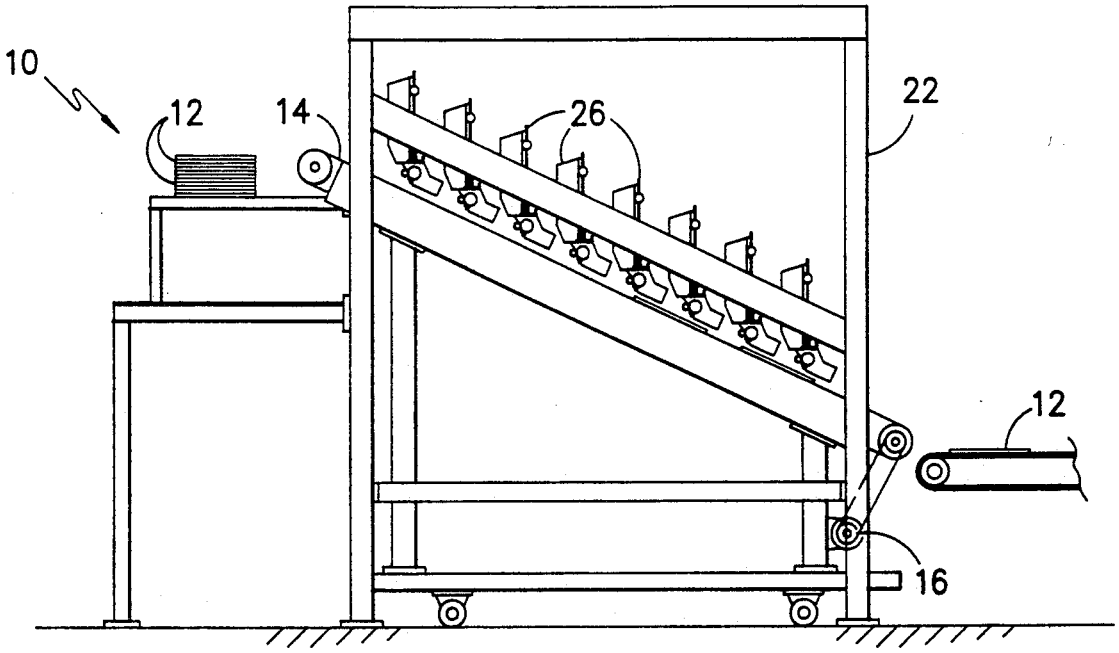
FIG. 4 is a diagrammatic side view of the array configuration of a dyeing apparatus of a kind for which the instant invention may be adapted, depicting eight dye-emitting arrays positioned above a section of a substrate web to be patterned.

FIG. 4 depicts, in a side elevation view, a set of eight individual arrays 26 positioned within frame 22. These arrays form part of a pattern dyeing machine to which the present invention is particularly suited. Each array 26 is comprised of a plurality of dye jets, arranged in spaced alignment, which extend generally above and across the width of tiles 12. Tiles 12 are supplied from a supply of tiles 10 and are transported in turn under each array 26 by conveyor 14 driven by a suitable motor indicated generally at 16. After being transported under arrays 26, tile 12 may be passed through other dyeing-related process steps such as drying, fixing, etc.

Figure 5:
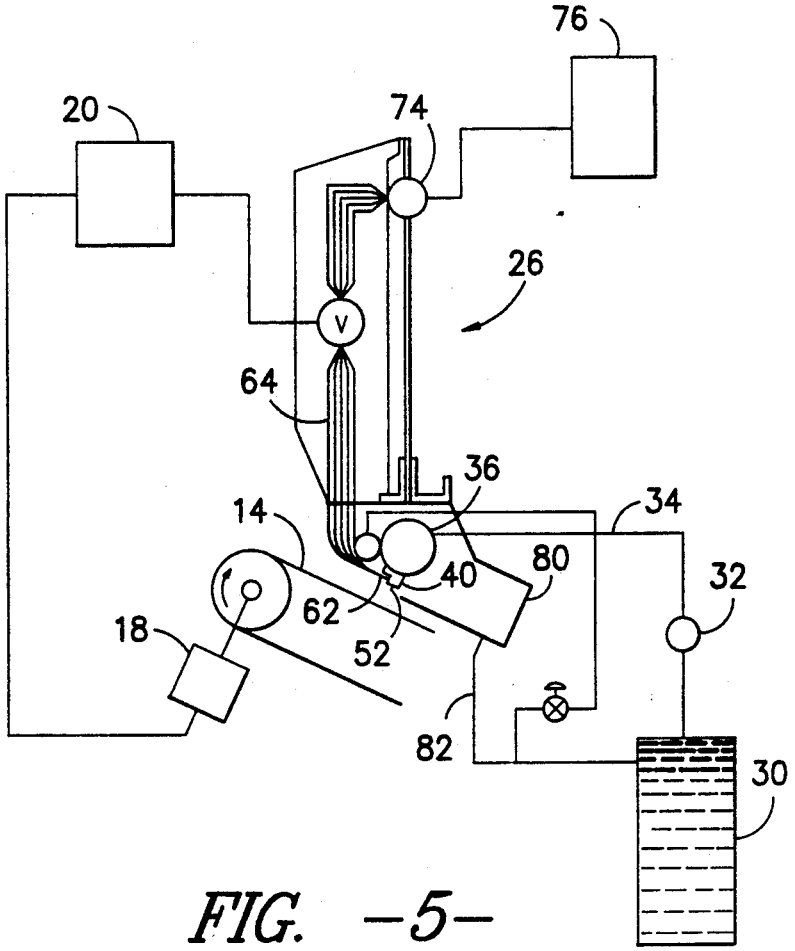
FIG. 5 is a schematicized diagram of a portion of the apparatus of FIG. 4.

FIG. 5 depicts, in schematic form, a side elevation of one dye-emitting array of the machine of FIG. 4. For each such array shown generally at 26, a separate dye reservoir tank 30 supplies liquid dye under pressure, by means of pump 32 and dye supply conduit means 34, to a primary dye manifold assembly 36 of the array. Primary manifold assembly 36 communicates with and supplies dye to dye sub-manifold assembly 40 at suitable locations along their respective lengths. Both manifold assembly 36 and sub-manifold assembly 40 extend across the width of conveyor 14 on which the substrate to be dyed in transported. Sub-manifold assembly 40 is provided with a plurality of spaced, generally downwardly directed dye passage outlets positioned across the width of conveyor 14 which produce a plurality of parallel dye streams which are directed onto the substrate surface to be patterned.

As shown, positioned in alignment with and approximately perpendicular to each dye passage outlet 52 in sub-manifold assembly 40 is the outlet of an air deflection tube 62. Each tube 62 communicates by way of an air deflection conduit 64 with an individual air valve, which valve selectively interrupts the flow of air to air tube 62 in accordance with pattern information supplied by pattern control device 20. Each valve is, in turn, connected by an air supply conduit to a pressurized air supply manifold 74 which is provided with pressurized air by air compressor 76. Each of the valves V, which may be of the electromagnetic solenoid type, are individually controlled by electrical signals from a pattern control device 20. The outlets of deflection tubes 62 direct streams of air which are aligned with and impinge against the continuously flowing streams of dye flowing from dye passage outlets 52 and deflect such dye streams into a primary collection chamber or trough 80, from which liquid dye may be removed, by means of a suitable dye collection conduit means 82, to dye reservoir tank 30 for recirculation.

The pattern control device 20 for operating solenoid valves V may be comprised of various pattern control means, such as a computer with pattern information storage capabilities. Desired pattern information from control device 20 is transmitted to the solenoid valves of each array at appropriate times in response to movement by conveyor 14 which is detected by suitable rotary motion sensor or transducer means 18 operatively associated with the conveyor 14 and connected to control device 20. Details of one means to perform this function may be found in commonly assigned U.S. Pat. No. 4,033,154, issued Jul. 5, 1977, which disclosure is hereby incorporated by reference.

In a typical dyeing operation utilizing such apparatus, so long as no pattern information is supplied by control device 20 to the air valves V associated with the array of dye outlets 52, the valves remain "open" to permit passage of pressurized air from air manifold 74 through air supply conduits 64 to continuously deflect all of the continuously flowing dye streams from the dye outlets 52 into the primary collection chamber 80 for recirculation. When the substrate 12 initially passes beneath the dye outlets 52 of the individual arrays 26, pattern control device 20 is actuated in suitable manner, such as manually by an operator. Thereafter, signals from transducer 18 prompt pattern information from pattern control device 20. As dictated by the pattern information, pattern control device 20 generates control signals to selectively "close" appropriate air valves so that, in accordance with the desired pattern, deflecting air streams at specified individual dye outlets along the arrays 26 are interrupted and the corresponding dye streams are not deflected, but instead are allowed to continue along their normal discharge paths to strike the tile 12. Thus, by operating the solenoid air valves of each array in the desired pattern sequence, a colored pattern of dye is placed on the substrate during its passage under the respective array.

As discussed briefly before, carpet tiles when placed adjacent to one another tend to show the seam therebetween creating what can be called the zipper effect. This is especially harmful when carpet tiles are used in place of broadloom carpet in residences and/or large rooms where the design on the carpet has to match the decor of the room or rooms. To overcome this problem, the controller 20 is supplied pattern information to dye the carpet tiles with a subliminal design 100 overprinted with a darker geometric motif 102.

Figure 1:
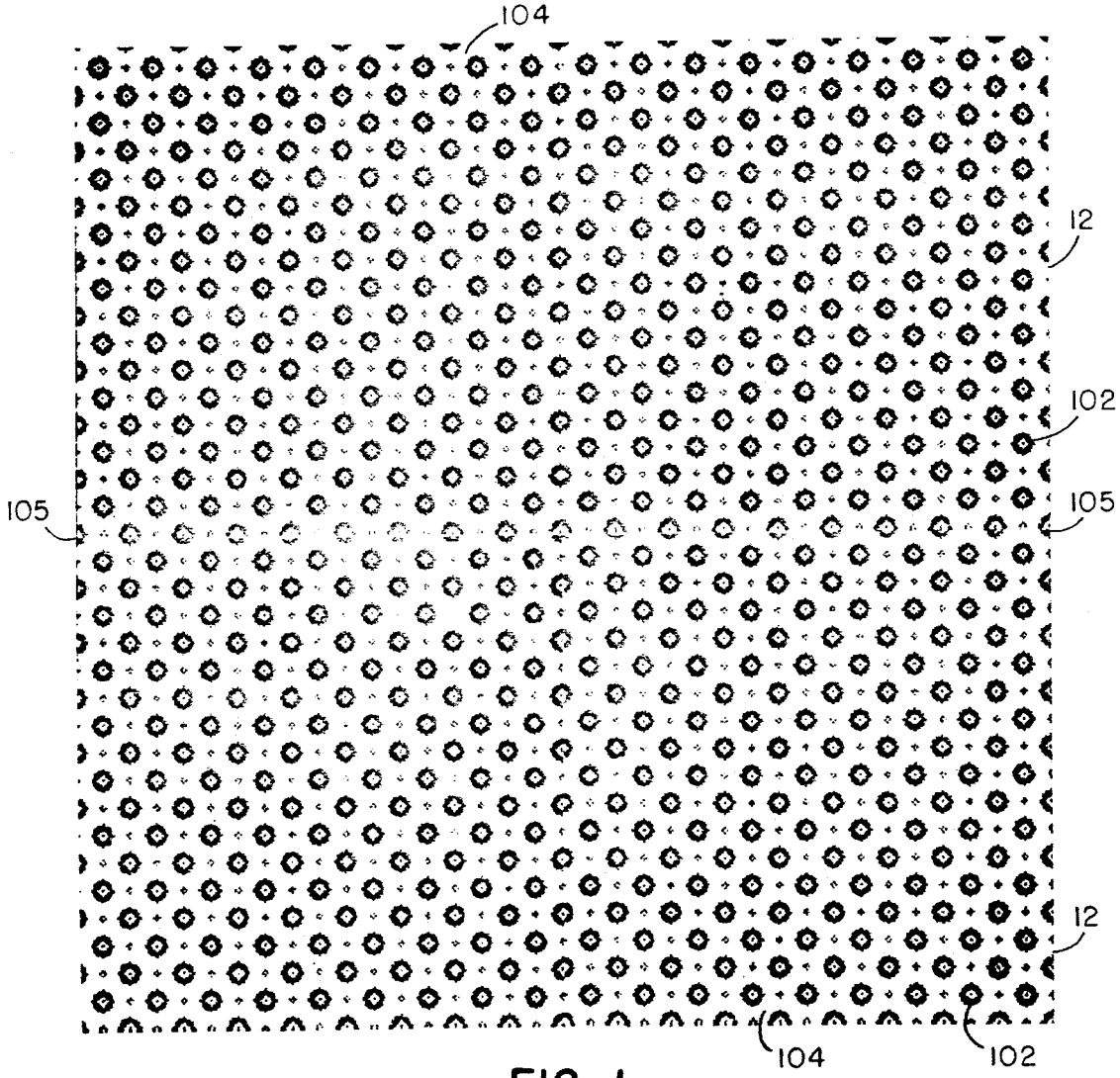
FIG. 1 shows one unacceptable solution to the described problem.

As shown in FIG. 1 an attempt was made to solve this problem by supplying pattern information to the controller 20 to dye the background 104 a solid light color and a darker geometric design 102 thereon with the geometric design 102 crossing the seam line 105. It can readily be seen that the seam 105 has a zipper effect created by the mismatching of the geometric design.

Figure 2:
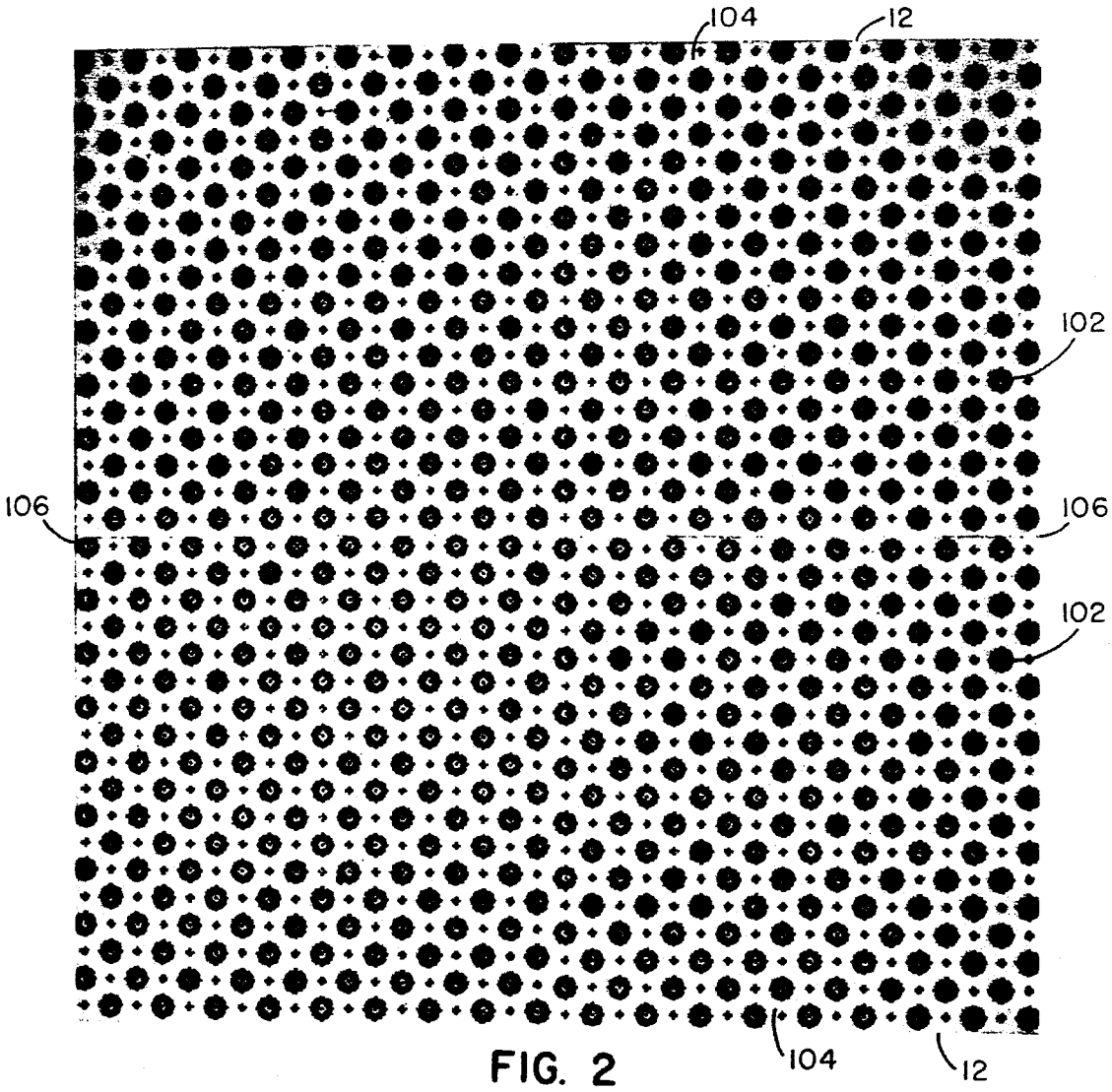
FIG. 2 shows another unacceptable solution to the described problem.

Then, as shown in FIG. 2 an attempt was made to control the controller 20 so that the geometric design or motif was moved off the tile resulting in the even more pronounced seam line 106.

Figure 3:
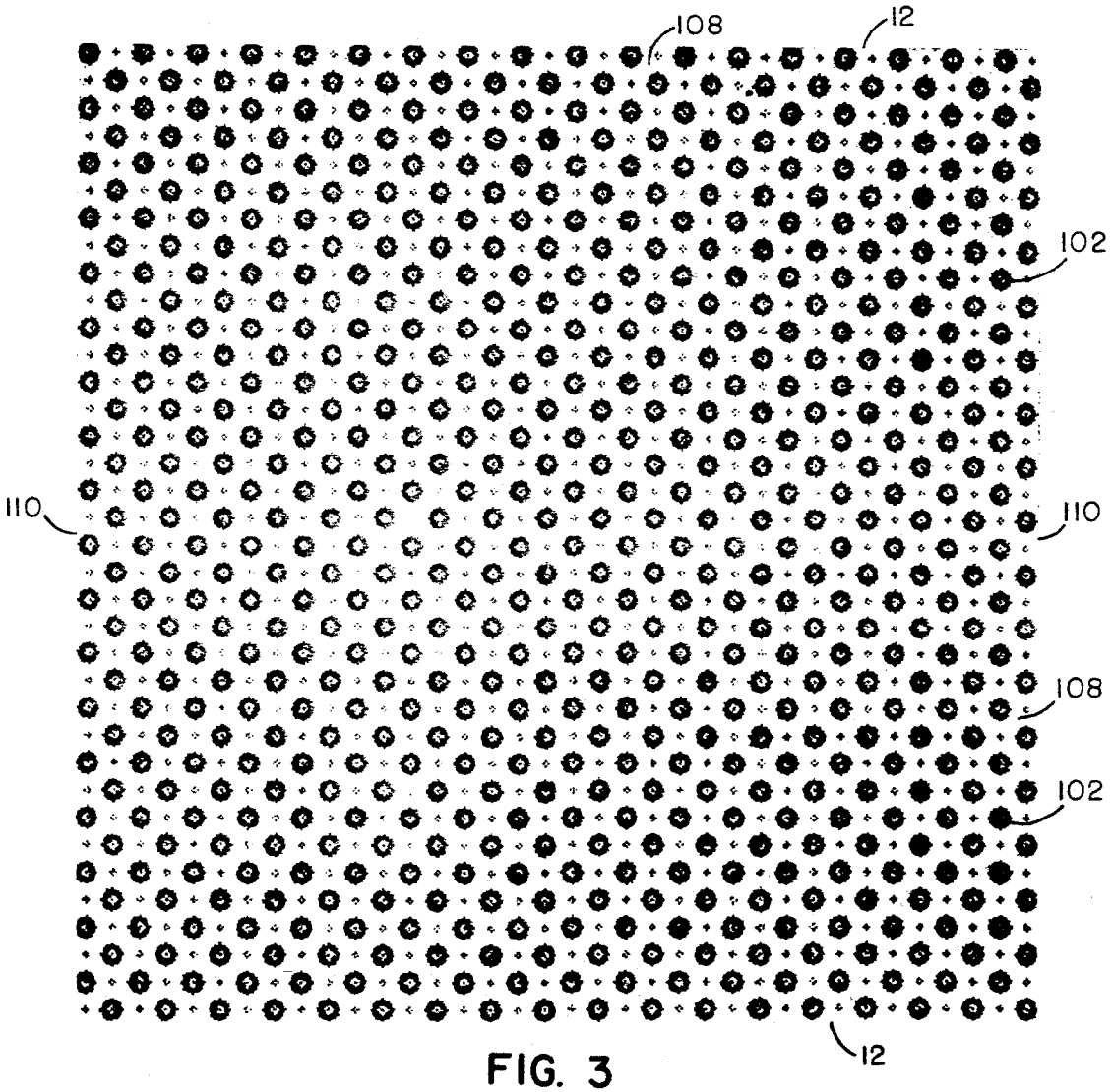
FIG. 3 shows two abutting tiles dyed in the novel disclosed manner.

Finally, the solution shown in FIG. 3 was conceived after the experience gained from the problems shown in FIGS. 1 and 2. In FIG. 3 the controller 20 was supplied with the information necessary to dye a subliminal floral or small cobblestone-like background design 108 and then place a geometric design thereon which crosses the seam line 110. As can readily be seen the seam line 110 is almost invisible to the naked eye. The particular subliminal design 108 and the particular primary design 102 are not part of the invention so long as the combination of the two designs printed on the tile 12 conceal the seam line when two tiles are placed in abutting relationship.

In all the examples of FIGS. 1–3 the background was light and the design was dark but obviously the reverse coloring can be used within the scope. Also the primary design 102 is preferably geometric but other designs can be employed within the scope of the invention so long as the design crosses the seam line 110 in the manner shown and disclosed.

It can readily be seen that the method of dyeing or printing the carpet tiles solves the problem of zippering when placed adjacent one another and other modifications may be made within the scope of the invention and it is therefore desired that the invention be limited only by the scope of the claims.

I claim:

1. Method to dye pile fabrics so that when two dyed fabrics are placed abutting one another the seam line therebetween is not discernible to the human eye comprising the steps of: dyeing the pile fabric with an overall subliminal background design and then placing a second design on said fabric which is a different shade of color than the background design and crosses the seam line of the pile fabric.

2. The method of claim 1 wherein the second design is geometric.

3. The method of claim 1 wherein the pile fabric are carpet tiles to be placed against one another on the floor to form a carpeted surface.

4. The method of claim 3 wherein the second design is darker than the subliminal background.

5. The method of claim 3 wherein other carpet tiles are dyed in the same manner so that the geometric design on different tiles when placed abutting one another complement each other and the subliminal design on each tile disguises the seam line between adjacent tiles when placed upon a surface to be carpeted.

6. The method of claim 5 wherein the second design is darker than the subliminal background design.

7. Method to jet dye carpet tiles on a dye machine having a plurality of rows of electronically controlled dye jets in each row and a computer controlled controller to actuate selected dye jets at preselected times comprising the steps of: moving a carpet tile under the rows of dye jets and causing the dye jets to form a subliminal background design on top of the carpet tile, continue moving the carpet tile under the dye jets and causing the dye jets to place a second design on top of the subliminal background design with a portion of the second design crossing the edge of the carpet tile and removing the dyed carpet tile from the jet dye machine.

8. The method of claim 5 wherein the second design is geometric.

* * * * *

UNITED STATES PATENT AND TRADEMARK OFFICE

CERTIFICATE OF CORRECTION

PATENT NO. : 5,179,749

DATED : January 19, 1993

INVENTOR(S) : Ronald Magee

It is certified that error appears in the above-identified patent and that said Letters Patent is hereby corrected as shown below:

In the ABSTRACT, line 1 delete "dry" and insert —dye—

Signed and Sealed this

Sixteenth Day of November, 1993

*Attest:*

Bruce Lehman

BRUCE LEHMAN

*Attesting Officer*

*Commissioner of Patents and Trademarks*